United States Patent [19]

Tanimura

[11] 4,032,141

[45] June 28, 1977

[54] AMUSEMENT DEVICE

[76] Inventor: Tomihiro Tanimura, No. 9-10, Tateishi, Katsushika, Tokyo, Japan

[22] Filed: Mar. 9, 1976

[21] Appl. No.: 665,323

[30] Foreign Application Priority Data

Oct. 29, 1975 Japan ..... 50-147259[U]

[52] U.S. Cl. ..... 273/1 L; 273/100; 46/44

[51] Int. Cl.[2] ..... A63F 9/00

[58] Field of Search ..... 273/1 R, 1 L, 95 C, 273/100, 104; 46/44

[56] References Cited

UNITED STATES PATENTS

| | | | |
|---|---|---|---|
| 806,255 | 12/1905 | Hughes | 273/1 L |
| 1,850,715 | 3/1932 | Gottfried | 273/1 R X |
| 2,100,898 | 11/1937 | Bernett | 46/44 X |

FOREIGN PATENTS OR APPLICATIONS

| | | | |
|---|---|---|---|
| 1,176,080 | 11/1958 | France | 46/118 |
| 637,984 | 5/1950 | United Kingdom | 273/100 |

OTHER PUBLICATIONS

Tomy 1976 Catalog, p. 18, received Feb. 1976.

*Primary Examiner*—William H. Grieb

[57] ABSTRACT

An amusement device including a transparent enclosure which is filled with a fluid such as water and having one or more goals within the enclosure. Also within the enclosure are a plurality of objects having a specific gravity greater than that of the fluid. Through the base of the enclosure protrudes one end of a tube, the other end thereof being attached to a bellows-like pump. The tube and pump are also filled with the fluid. The player, by actuating the pump forces the fluid through the tube into the enclosure, the resulting movement of the fluid causing the objects within the enclosure to travel upwardly until the player releases the button and/or substantially all of the fluid has been forced from the pump, at which time each of the propelled objects begins to sink and is either caught by one of the goals, falls into a default trap, or descends back to a position from which the player can again cause it to be projected upwardly for another attempt to score a goal.

14 Claims, 3 Drawing Figures

AMUSEMENT DEVICE

BACKGROUND AND SUMMARY OF THE INVENTION

The present invention relates to the general class of amusement devices wherein movement of objects submerged in a fluid is promoted with the use of a pump that when actuated directs currents in the fluid into engagement with the submerged objects moving same in a desired path. With the present invention, rings having a specific gravity just slightly greater than water are directed upwardly within a transparent enclosure, by a pumping mechanism consisting of a flexible bellows, to thereafter drift slowly downwardly either to be caught by spiked goals or to be deposited either in a default area where further play is impossible or in an area whereby actuation of the pumping mechanism again directs the rings upwardly to begin drifting downwardly again.

DESCRIPTION OF THE PREFERRED EMBODIMENT

Figure 1:
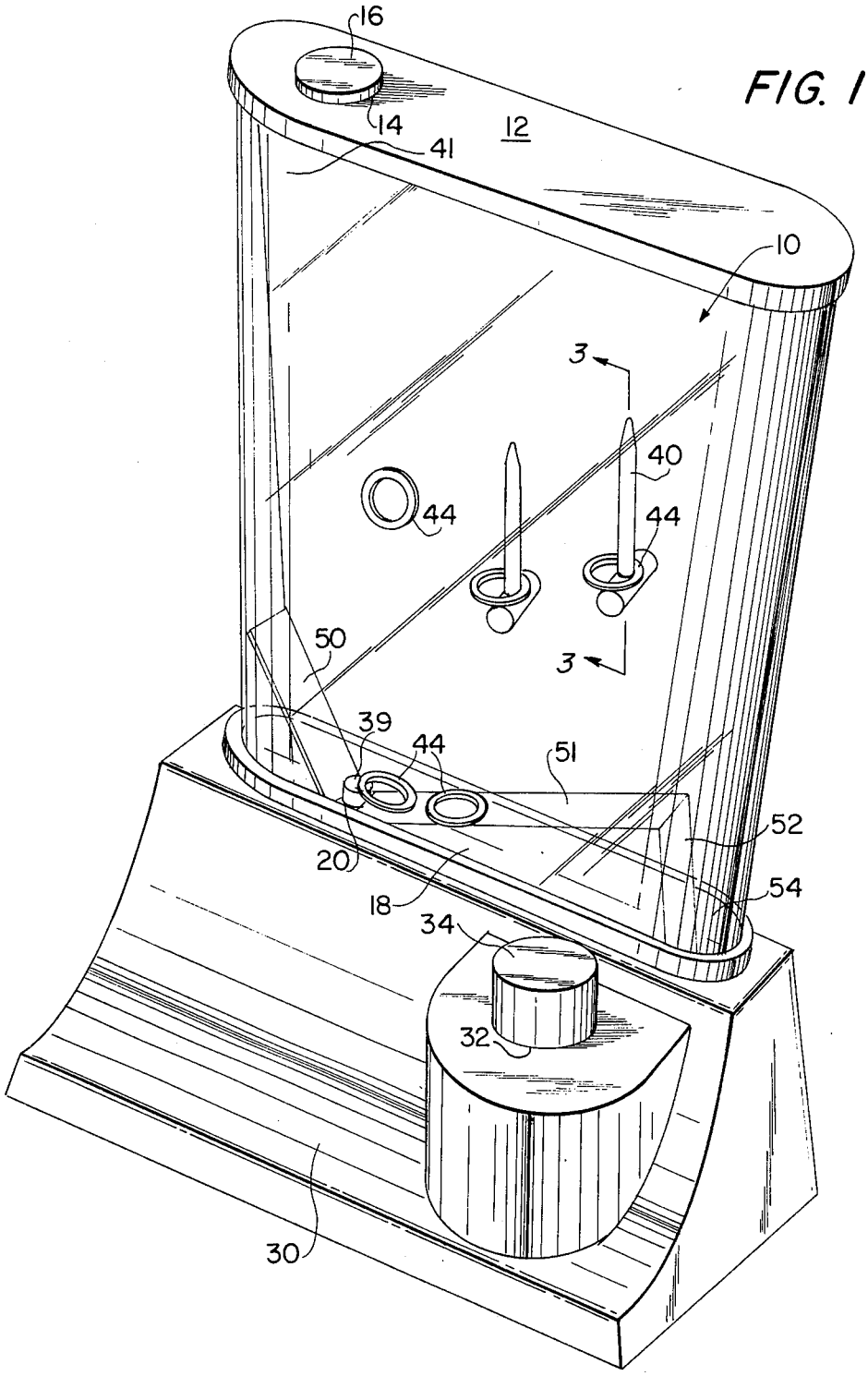
FIG. 1 is a perspective view of the preferred embodiment of the amusement device of the present invention illustrating the transparent enclosure, goals and the push button and bellows-like pump.

As illustrated in FIG. 1, the amusement device of the present invention features a transparent enclosure 10. Where a liquid, for example, water, is used, the enclosure 10 is provided with a top member 12 having a hole 14 through which the liquid may be poured and a stopper 16. The bottom member 18 of the enclosure 10 is provided with an opening 20 and is affixed by any suitable structure to a base 30 within which is mounted a push-button 34 protruding outwardly through an opening 32. Within the base 30 is a flexible bellows-like pump 36 operably connected to the push-button 34 with a fluid-tight seal 35.

Figure 2:
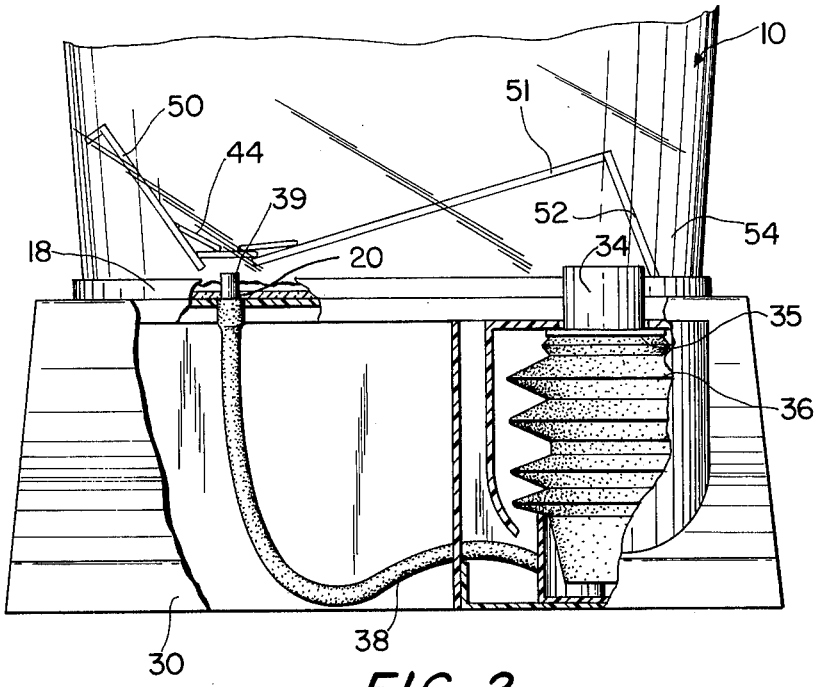
FIG. 2 is a front elevational view of the lower portion of the present invention partly in section illustrating the mechanism operatively connecting the bellows-like pump to an opening in the bottom of the enclosure through which fluid is forced to carry the objects upwardly.

As illustrated in FIG. 2, a tube 38 operatively connects the bellows-like pump 36 to the opening 20 within the bottom member 18 of the enclosure 10. It is apparent that the open end 39 of the tube 38 protrudes through the opening 20.

Figure 3:
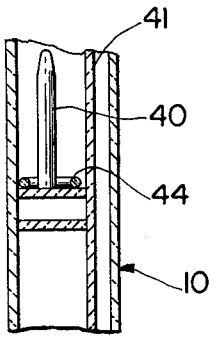
FIG. 3 is a sectional view taken along line 3—3 of the FIG. 1 illustrating one of the objects immediately above one of the goals and one of the objects caught on the goal.

There are two stationery goals or targets 40 which may be affixed to the walls of the enclosure 10, or as illustrated in the preferred embodiment of FIG. 3, may be attached to a transparent sheet 41 slidably mounted within the enclosure. It will be apparent that by mounting the goals 40 to the sheet 41 it is possible to simplify the manufacture and assembly of the component parts. The reference numeral 34 designates generally a plurality of small rings 44 which may be of any material having a higher specific gravity than the fluid within the enclosure 10 such that the rings 44 will move through the liquid very slowly. From the foregoing, it will be apparent that the object of the game is to catch as many of the rings 44 as possible on the spiked goals 40.

As illustrated in FIGS. 1 and 2, there are also mounted to the transparent sheet 41, ramps 50 and 51, each of which terminates downwardly in abutting relationship against the bottom member 18 of the enclosure 10 in close proximity to the opening 20. The ramp 51 is connected to a generally vertically disposed support member 52 which, together with the side of the enclosure 10 defines a default trap 54.

To operate the game the player depresses the push-button 34 which causes the bellows-like pump 36 to contract which, in turn, forces water from the bellows-like pump 36 through the tube 38 into the fluid-filled enclosure 10. The force of the upwardly moving fluid from the tube 38 creates currents in a generally upward direction. The upwardly moving currents cause any of the rings 44 located between the ramps 50 and 51 to be projected upwardly. It will be apparent that by varying the speed and force with which the push-button 34 is depressed, the player can vary force of the currents of fluid, and in so doing regulate how high the rings 44 move upwardly within the enclosure 10, as well as regulating the length of time the rings 44 remain suspended with the fluid. After all of the fluid from the bellows-like pump 36 has been expelled through the tube 38, or the player ceases depressing the push-button 34, the currents cease and the rings 44 thereafter begin to sink downwardly toward the bottom of the enclosure 10 with three possible results. It is possible that one or more of the rings 44 may score a hit by settling over one of the spiked goals 40. Alternatively, one or more of the rings 44 may settle into the default trap 54 rendering the ring 44 inoperative in the sense that further movement of the button 34 will have no effect on such ring which is shielded from the currents being generated between the ramps 50 and 52. Finally, or more of the rings 44 may descend eventually striking the ramps 50 or 51 eventually being deposited in close proximity to the open end 39 of the tube 38 in which case the player may continue to attempt to achieve the object of the game by again pressing the push-button 34. The game is over when all of the rings 44 have either been caught by the spiked goals 40 or have fallen into the default trap 54.

I claim:

1. An amusement device, comprising a transparent enclosure for containing a liquid, at least one object within said enclosure having a specific gravity greater than the specific gravity of the liquid, target means within said enclosure for holding said object, pump means connected to the interior of said enclosure for transmitting liquid into said enclosure to generate currents within the liquid to cause said object to move within said enclosure sure towards said target means.

2. An amusement device as in claim 1, wherein said pump means for transmitting liquid comprises an outlet for the liquid positioned in the vicinity of the bottom of the enclosure, said target means being positioned above said outlet, and guide means positioned within said enclosure sloping downwardly toward said outlet to permit said object under the influence of gravity to move downwardly to said outlet.

3. An amusement device as in claim 2, wherein said transparent enclosure has a side wall, and said guide means comprises a first wall having a first end adjacent said outlet and extending upwardly terminating in a second end adjacent said side wall of said enclosure, and a second wall having a first end adjacent said outlet and extending upwardly therefrom.

4. An amusement device as in claim 2, wherein said pump means for transmitting liquid further comprises a bellows-like pump, a push-button connected to said pump, and conduit means connecting said pump and said outlet.

5. An amusement device as in claim 4, including additional guide means within said enclosure sloping downwardly away from said outlet to permit said object under the influence of gravity to move downwardly away from said outlet.

6. An amusement device as in claim 5, wherein said additional means comprises a third wall having a first end at said bottom of said enclosure and spaced from said side wall thereof, said third wall extending upwardly joining said second wall.

7. An amusement device as in claim 5, wherein said target means comprises a spike and wherein said object comprises a ring.

8. An amusement device as in claim 7, further comprising a transparent sheet slidably mounted within said enclosure, said target and guide means being attached to said transparent sheet.

9. In the combination of a transparent container, a body of a transparent liquid held within the container, at least one subject in said liquid within said container, the density of said object being greater than the density of said liquid, and at least one target means for engaging and holding said object above the bottom of said container as said liquid is moved, the improvement comprising means for moving said liquid within the interior of said container so as to move said object within said container in order to give said object the opportunity of being retained by said target means.

10. The combination of claim 9, wherein said means for moving said liquid comprises a bellows-like pump, conduit means operatively connecting said pump to the interior of said container at a position in the vicinity of the bottom of said container, said conduit means being positioned above said position where said conduit is connected to said container.

11. The combination of claim 10, wherein said pump and said conduit means are positioned outside of said transparent container, said position at which said conduit means and said container are connected being defined by an opening in said container.

12. An amusement device wherein objects are directed within a body of liquid to a target that is capable of holding the objects, comprising a transparent sealed enclosure provided with an opening therein, pump means operatively connected to said opening with said enclosure, a transparent sheet, means slidably mounting said sheet within said enclosure, target means provided on said sheet, and guide means provided on said sheet directed toward said opening within said enclosure.

13. A amusement device as in claim 12, wherein said guide means comprises two portions sloping downwardly and terminating at said opening within said enclosure, and further comprising additional guide means provided on said sheet and sloping downwardly away from said opening within said enclosure.

14. An amusement device as in claim 13, wherein said pumping means comprises a bellows-like pump and actuating mechanism positioned outside of said transparent enclosure, an opening within said transparent enclosure, and a conduit connecting said pump and said opening.

* * * * *

UNITED STATES PATENT AND TRADEMARK OFFICE

CERTIFICATE OF CORRECTION

PATENT NO. : 4,032,141

DATED : June 28, 1977

INVENTOR(S) : Tomihiro Tanimura

It is certified that error appears in the above-identified patent and that said Letters Patent are hereby corrected as shown below:

Column 2, line 55, delete "sure".

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*